US005462604A

United States Patent [19]

Shibano et al.

[11] Patent Number: 5,462,604

[45] Date of Patent: Oct. 31, 1995

[54] METHOD OF OSCILLATING ULTRASONIC VIBRATOR FOR ULTRASONIC CLEANING

[76] Inventors: Yoshihide Shibano, 1629-1-12, Oyama-cho, Machida-shi, Tokyo; Tsutou Saito, 8-12, Aza Yakumojinja, Ooaza Sekiwaku, Izumisaki-mura, Nishishirakawa-gun, Fukushima-ken, both of Japan

[21] Appl. No.: 199,646

[22] Filed: Feb. 22, 1994

[30] Foreign Application Priority Data

Feb. 22, 1993 [JP] Japan ..... 5-032140

[51] Int. Cl.[6] ..... B08B 3/12

[52] U.S. Cl. ..... 134/1; 134/18; 134/34; 310/316; 310/317

[58] Field of Search ..... 134/1, 18, 34; 310/316, 317

[56] References Cited

U.S. PATENT DOCUMENTS

| | | | |
|---|---|---|---|
| 3,866,068 | 2/1975 | Krenicki et al. | 310/316 |
| 3,975,650 | 8/1976 | Payne | 310/316 |
| 4,736,130 | 4/1988 | Puskas | 310/316 |
| 5,076,854 | 12/1991 | Honda et al. | 134/1 |
| 5,109,174 | 4/1992 | Shewell | 310/317 |
| 5,137,580 | 8/1992 | Honda | 134/1 |

FOREIGN PATENT DOCUMENTS 1516218 1/1968 France .

OTHER PUBLICATIONS

*Encyclopedia of Electronics*, pp. 540, 703–705, 1985.

*Primary Examiner*—W. Gary Jones
*Assistant Examiner*—Sean Vincent
*Attorney, Agent, or Firm*—Paul A. Guss

[57] ABSTRACT

An ultrasonic vibrator has a single natural frequency for radiating ultrasonic energy into a cleaning solution to clean and deburr workpieces that are immersed in the cleaning solution. A plurality of oscillating signals having respective different frequencies which are integral multiples of the natural frequency of the ultrasonic vibrator are generated, and successively outputted for respective periods of time thereby to generate a composite signal which is composed of a time series of the oscillating signals. The composite signal is applied as a drive signal to the ultrasonic oscillator to oscillate the ultrasonic vibrator. The oscillating signals may be outputted successively for said respective periods of time or intermittently with quiescent periods inserted therebetween.

10 Claims, 6 Drawing Sheets

LIQUID LEVEL
$\frac{1}{4}\lambda_1$
$\frac{1}{2}\lambda_1$
e(25KHz)
$\frac{1}{4}\lambda_2$
$\frac{1}{2}\lambda_2$
f(75KHz)
$\frac{1}{4}\lambda_3$
$\frac{1}{2}\lambda_3$
g(125KHz)
1
1
1

FREQUENCY : 25KHz

FREQUENCY : 50KHz

METHOD OF OSCILLATING ULTRASONIC VIBRATOR FOR ULTRASONIC CLEANING

BACKGROUND OF THE INVENTION

1. Field of the Invention

The present invention relates to a method of oscillating an ultrasonic vibrator for use in ultrasonically cleaning (including deburring) workpieces immersed in a cleaning solution.

2. Description of the Prior Art

For ultrasonically cleaning workpieces immersed in a cleaning solution in a cleaning tank, it has been customary to apply a periodic voltage signal to an ultrasonic vibrator having a piezoelectric element, the periodic voltage signal having a frequency equal to the natural frequency of the ultrasonic vibrator, to oscillate the ultrasonic vibrator at its natural frequency for thereby radiating an ultrasonic energy into the cleaning solution. The radiated ultrasonic energy produces a cavitation in the cleaning solution, which generates shock waves to clean and deburr the workpieces immersed in the cleaning solution.

It is generally known that the cavitation in the cleaning solution appears at a depth depending on the frequency of the radiated ultrasonic energy, i.e., the natural frequency (resonant frequency) of the piezoelectric element of the ultrasonic vibrator. More specifically, when the ultrasonic energy is radiated from the bottom of the cleaning tank toward the surface level of the cleaning solution in the cleaning tank, the cavitation is produced intensively at a depth equal to a quarter wavelength, and also at depths positioned successively at quarter wavelength intervals from that depth toward the bottom of the cleaning tank.

For uniformly cleaning and deburring the workpieces immersed in the cleaning solution, it is preferable to generate the cavitation uniformly in the cleaning solution without being dispersed in the cleaning solution. To generate the cavitation uniformly in the cleaning solution, it is desirable to radiate the ultrasonic energy at a higher frequency. It is also generally known that the higher the frequency of the radiated ultrasonic energy, the more the ultrasonic energy is attenuated in the cleaning solution, resulting in a lowered cavitation effect. For effective cleaning or deburring of the workpieces, therefore, it is preferable to radiate the ultrasonic energy at a lower frequency. Since the generation and effect of the cavitation vary depending on the frequency of the ultrasonic energy, the frequency of the ultrasonic energy should be selected in view of the purpose for which the workpieces are to be cleaned and the degree to which the workpieces are to be cleaned. For example, if a stronger cleaning capability is desirable, then the ultrasonic energy should be applied at a lower frequency. If the workpieces to be cleaned are fragile, then the ultrasonic energy should be applied at a higher frequency in order to prevent the workpieces from being damaged by the cavitation.

However, where an ultrasonic vibrator having a single natural frequency is oscillated at the natural frequency, the above requirements cannot be satisfied under various conditions.

One solution has been to employ an ultrasonic vibrator having a plurality of piezoelectric elements having respective different natural frequencies, and repeatedly apply a plurality of signals having frequencies equal to the natural frequencies to the respective piezoelectric elements for respective periods of time. Therefore, ultrasonic energies are radiated at different frequencies from the single ultrasonic vibrator into the ultrasonic solution.

When the ultrasonic energies are radiated into the ultrasonic solution, cavitations are produced at relatively close depths, respectively, in the cleaning solution. As a result, the cavitations are distributed comparatively uniformly in the cleaning solution, and it is possible to obtain an effective cavitation effect primarily based on those ultrasonic energies which have lower frequencies. A suitable choice of periods of time for which the ultrasonic energies having different frequencies are radiated is effective to serve different purposes for which workpieces are to be cleaned.

The ultrasonic vibrator with plural piezoelectric elements having respective different natural frequencies, however, is difficult and expensive to manufacture. Another problem is that the cavitation distribution becomes unstable because the natural frequencies of the piezoelectric elements tend to vary due to the heat produced thereby when the ultrasonic vibrator is oscillated. Consequently, it has been difficult to clean and deburr the workpieces uniformly with the cavitations.

SUMMARY OF THE INVENTION

It is therefore an object of the present invention to provide a method of oscillating an ultrasonic vibrator which has a single natural frequency to easily generate uniform cavitations in various positions in a cleaning solution.

Another object of the present invention is to provide a method of oscillating an ultrasonic vibrator to obtain a cavitation distribution suitable for the type of workpieces to be cleaned and the purpose for which the workpieces are to be cleaned.

As a result of various studies, the inventors have found out that when an ultrasonic vibrator having a single natural frequency is oscillated with a drive signal having a frequency equal to either the natural frequency or an integral multiple of the natural frequency, it is possible to produce a cavitation sufficiently effectively in a cleaning solution. More specifically, a plurality of drive signals having respective different frequencies each equal to an integral multiple of the natural frequency of the ultrasonic vibrator are applied, one at a time, to the ultrasonic vibrator for a suitable period of time. At this time, the ultrasonic vibrator successively radiates ultrasonic energies having the respective different frequencies into the cleaning solution for thereby producing cavitations corresponding to the ultrasonic energies having the respective different frequencies, with the result that the cavitations are combined into a uniform cavitation in the cleaning solution. It has been found out that when each of the frequencies of the drive signals applied to the ultrasonic vibrator is a multiple by an odd number of the natural frequency of the ultrasonic vibrator, a uniform cavitation can effectively be produced in the cleaning solution.

According to the present invention, there is provided a method of oscillating an ultrasonic vibrator having a single natural frequency for radiating ultrasonic energy into a cleaning solution, comprising the steps of (a) generating a plurality of oscillating signals having respective different frequencies which are integral multiples of the natural frequency of the ultrasonic vibrator, (b) switching between and outputting the oscillating signals for respective periods of time thereby to generate a composite signal which is composed of a time series of the oscillating signals, and (c) applying the composite signal as a drive signal to oscillate the ultrasonic vibrator.

When the composite signal is applied to the ultrasonic vibrator, the ultrasonic vibrator radiates a time series of ultrasonic energies having different frequencies for the respective periods of time into the cleaning solution, based on the frequencies of the oscillating signals contained in the composite signal. The radiated ultrasonic energies cause cavitations to be produced in the cleaning solution, which are combined into a uniform distribution of cavitations in the cleaning solution.

The oscillating signals may be outputted successively for the respective periods of time, or one of the oscillating signals may be outputted, and then after elapse of a predetermined quiescent period, a next one of the oscillating signals may be outputted. At any rate, ultrasonic energies having frequencies corresponding to the frequencies of the oscillating signals are radiated from the ultrasonic vibrator into the cleaning solution.

Each of the respective periods of time may preferably be composed of unit periods of one of the oscillating signals to enable the ultrasonic vibrator to radiate ultrasonic energies having frequencies corresponding to the frequencies of the oscillating signals smoothly into the cleaning solution for the respective periods of time.

The respective periods of time may preferably be varied for the respective oscillating signals to obtain a cavitation distribution suitable for the purpose for which workpieces immersed in the cleaning solution are to be cleaned or the type of the workpieces.

Preferably, a rectangular-wave signal having the same frequency as the composite signal may be applied to the ultrasonic vibrator to oscillate the ultrasonic vibrator. When the ultrasonic vibrator is thus energized with the rectangular-wave signal, a driving energy is efficiently imparted to the ultrasonic vibrator, which is stably oscillated. A circuit arrangement for generating a rectangular-wave signal to energize the ultrasonic vibrator can simply be constructed of a digital circuit or the like.

The frequencies of the oscillating signals may preferably be multiples by odd numbers of the natural frequency of the ultrasonic vibrator for uniformizing a distribution of cavitations in the cleaning solution.

Generally, when a signal having a frequency which is an integral multiple of the natural frequency of the ultrasonic vibrator is applied to the ultrasonic vibrator, the higher the frequency, the greater the current which flows into the ultrasonic vibrator. Preferably, therefore, the step (c) may comprise the steps of amplifying the composite signal, controlling an amplification factor for the composite signal depending on the frequencies of the oscillating signals, and applying the amplified composite signal to the ultrasonic vibrator to oscillate the ultrasonic vibrator, and wherein the step of controlling an amplification factor for the composite signal comprises the step of reducing the amplification factor as the frequencies of the oscillating signals are higher. In this manner, an excessive current is prevented from flowing into the ultrasonic vibrator and an amplifier which supplies the signal thereto, so that the ultrasonic vibrator is prevented from being damaged.

When the oscillating signals are combined into the composite signal, and the composite signal is amplified and applied to the ultrasonic vibrator, if the amplification factor for the oscillating signals remains constant, then since the frequency of the signal applied to the ultrasonic vibrator is abruptly changed at the time the oscillating signals switch from one to another, the oscillation of the ultrasonic vibrator tends to be disturbed, producing noise. Therefore, it may be preferable to lower an amplification factor for the composite signal when the oscillating signals switch from one to another, and thereafter progressively increase the amplification factor to a predetermined level. Accordingly, when the oscillating signals switch from one to another, the signal applied to the ultrasonic vibrator increases progressively from a low level, with the result that the ultrasonic vibrator is oscillated smoothly at the frequencies of the oscillating signals.

In the step (a), a reference signal having a single frequency which is substantially an integral multiple of the natural frequency of the ultrasonic vibrator may be generated and frequency-divided to generate the oscillating signals. If the frequency of the reference signal remains constant, then when the natural frequency of the ultrasonic vibrator varies due to the heat thereof, for example, the current flowing into the ultrasonic vibrator varies, tending to make unstable the ultrasonic energies outputted from the ultrasonic vibrator. Therefore, it is preferable to adjust the frequency of the reference signal depending on the level of a current supplied to the ultrasonic vibrator in order to equalize the frequency of the reference signal with the integral multiple of the natural frequency of the ultrasonic vibrator. Thus, the frequencies of the oscillating signals contained in the composite signal applied to the ultrasonic vibrator are equalized with the integral multiples of the natural frequency of the ultrasonic vibrator, so that the ultrasonic energies outputted from the ultrasonic vibrator are stabilized at the respective frequencies of the ultrasonic vibrator.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 5(*b*) is a plan view of an aluminum foil which was eroded when the ultrasonic vibrator of the ultrasonic vibrating apparatus shown in FIG. 1 is energized at another certain frequency.

DETAILED DESCRIPTION OF THE PREFERRED EMBODIMENTS

Figure 1:
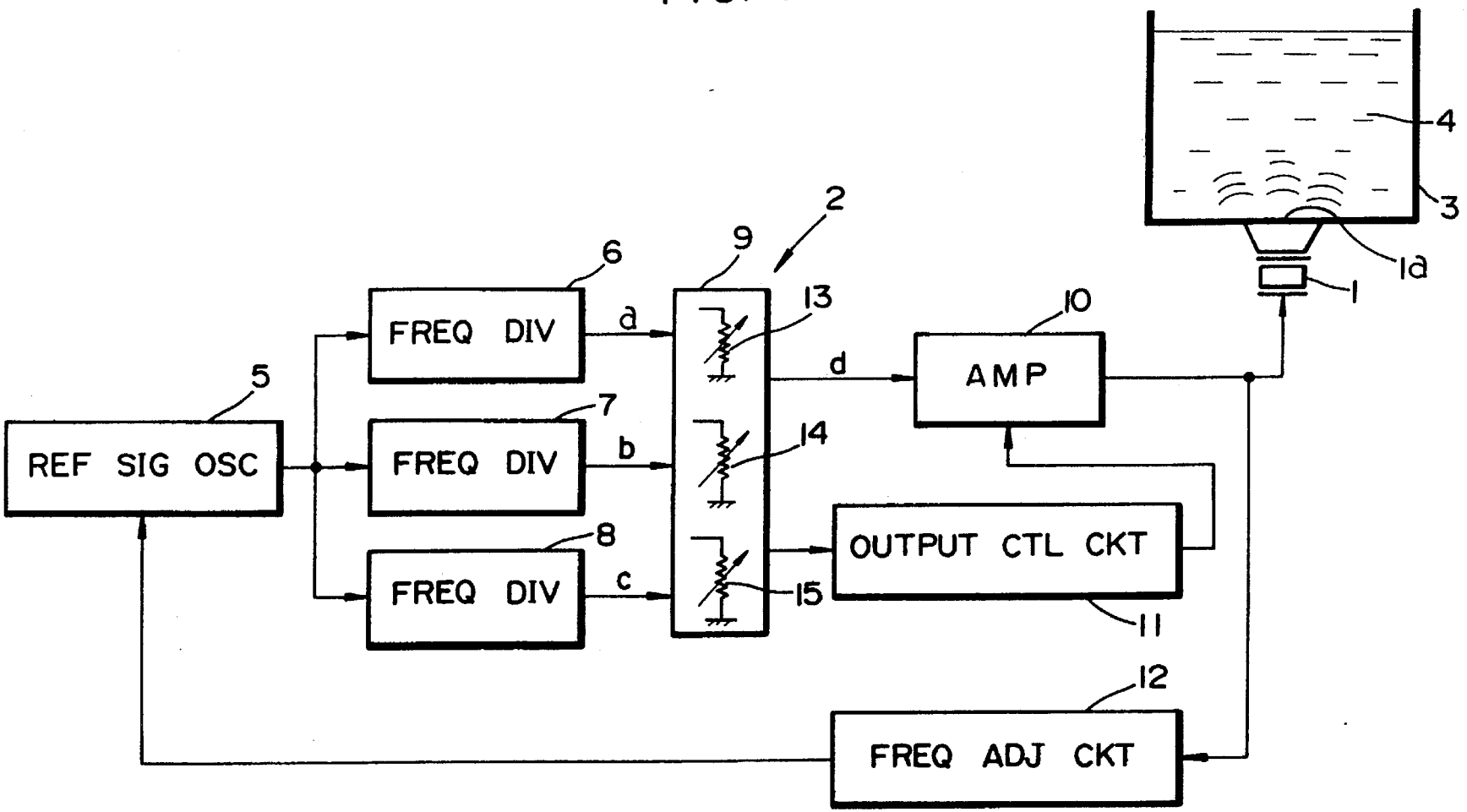
FIG. 1 is a block diagram of an ultrasonic vibrating apparatus to which a method according to the present invention is applied.

As shown in FIG. 1, an ultrasonic vibrating apparatus to which a method according to the present invention is applied includes an ultrasonic vibrator 1 having a single natural frequency, which is of 25 kHz in the embodiment shown in FIG. 1, and an ultrasonic oscillating circuit 2 for oscillating the ultrasonic vibrator 1. The ultrasonic vibrator 1 is of the Langevin type, for example, having a single piezoelectric element (not shown). The ultrasonic vibrator 1 is fixedly mounted on the bottom of a cleaning tank 3 with a vibrating surface 1*a* held in contact with a cleaning solution 4 contained in the cleaning tank 3.

The ultrasonic oscillating circuit 2, which constitutes a central portion of the ultrasonic vibrating apparatus, includes a reference signal oscillator 5 for generating a reference signal (rectangular-wave signal) having a high frequency, e.g., of several hundreds kHz, a plurality of (three in the illustrated embodiment) frequency dividers 6, 7, 8 for frequency-dividing the reference signal generated by the reference signal oscillator 5, a switching circuit 9 for switching and outputting output signals from the frequency dividers 6, 7, 8 in a time-series fashion, an amplifier 10 for amplifying an output signal from the switching circuit 9 and applying the amplified signal to the ultrasonic vibrator 1, an output control circuit 11 for adjusting the gain of the amplifier 10 depending on the frequency of the output signal from the switching circuit 9, and a frequency adjusting circuit 12 for effecting fine adjustment on the frequency of the signal generated by the reference signal oscillator 5 depending on an output current from the amplifier 10, i.e., the current supplied to the ultrasonic vibrator 1.

Figures 2A, 2B, 2C, 2D:
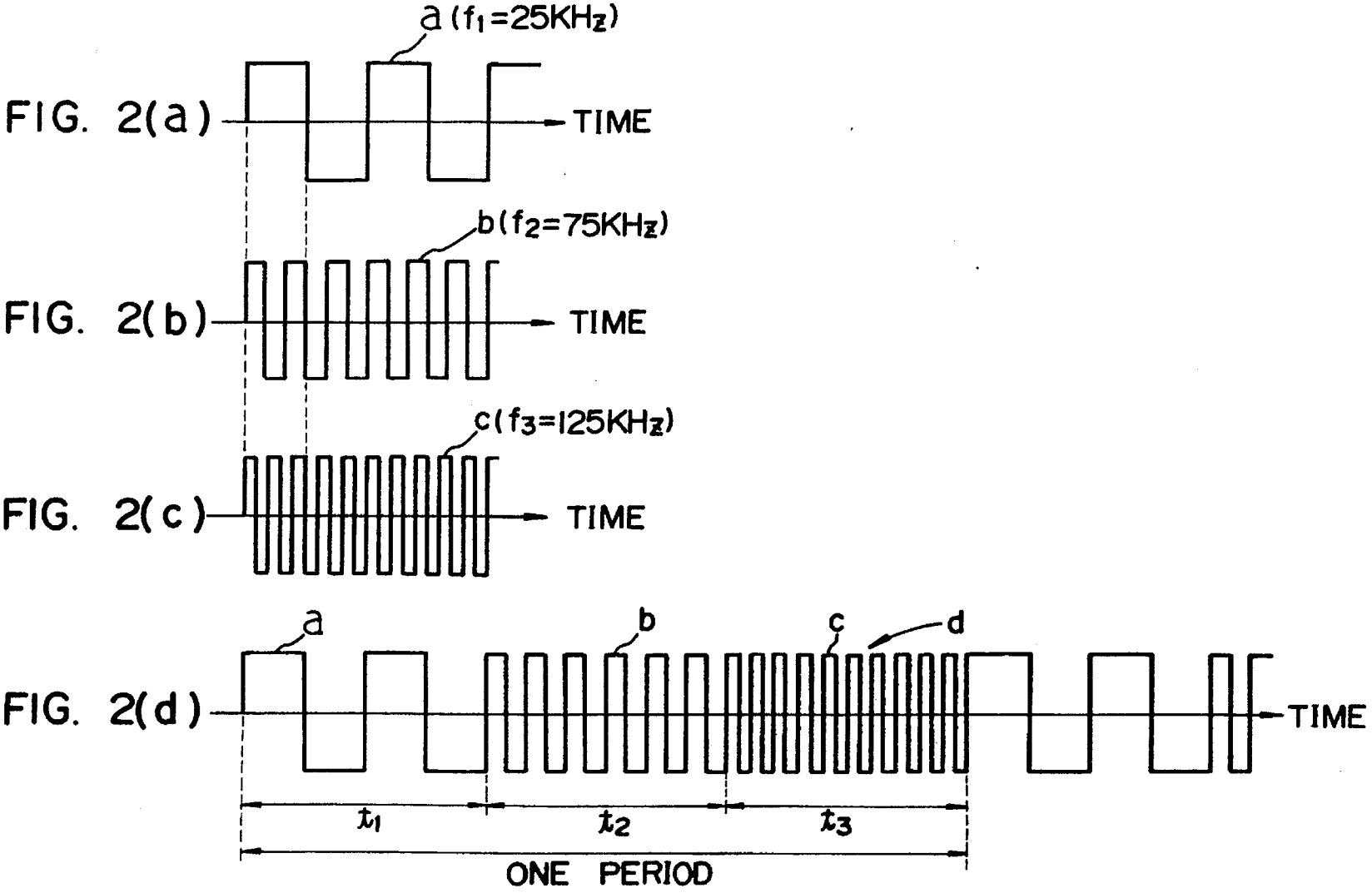
FIGS. 2(*a*), 2(*b*), 2(*c*) and 2(*d*) are diagrams illustrative of the manner in which the ultrasonic vibrating apparatus operates.

The frequency dividers 6, 7, 8 generate respective oscillating signals a, b, c (see FIGS. 2(*a*)–2(*d*)) having different frequencies $f_1$, $f_2$, $f_3$, respectively, from the reference signal generated by the reference signal oscillator 5, each of the frequencies $f_1$, $f_2$, $f_3$ being an integral multiple of the natural frequency of the ultrasonic vibrator 1. For example, the frequency divider 6 frequency-divides the reference signal generated by the reference signal oscillator 5 into the oscillated rectangular-wave signal a (see FIG. 2(*a*)) which has the same frequency $f_1$ ($f_1$=25 kHz) as the natural frequency of the ultrasonic vibrator 1. The frequency dividers 7, 8 frequency-divide the reference signal generated by the reference signal oscillator 5 into the oscillated rectangular-wave signals b, c (see FIGS. 2(*b*) and 2(*c*)) which have the respective frequencies $f_2$, $f_3$ ($f_2$=75 kHz, $f_3$=125 kHz) that are three and five times, respectively, the natural frequency of the ultrasonic vibrator 1. The oscillating signals a, b, c generated by the respective frequency dividers 6, 7, 8 are held in synchronism with each other.

The switching circuit 9 repeatedly outputs the oscillating signals a, b, c generated by the respective frequency dividers 6, 7, 8 successively over respective periods of time, thereby generating a composite signal d (see FIG. 2(*d*)) for energizing the ultrasonic vibrator 1. More specifically, the switching circuit 9 first outputs the oscillating signal a for a period of time $t_1$ that is an integral multiple of the period of the oscillating signal a from an initial positive-going edge. Thereafter, the switching circuit 9 outputs the oscillating signal b for a period of time $t_2$ that is an integral multiple of the period of the oscillating signal b, and then outputs the oscillating signal c for a period of time $t_3$ that is an integral multiple of the period of the oscillating signal c. The switching circuit 9 subsequently repeatedly outputs the oscillating signals a, b, c successively, thus generating the composite signal d. Therefore, the composite signal d generated by the switching circuit 9 is composed of a time series of oscillating signals a, b, c for respective periods of times $t_1$, $t_2$, $t_3$ within each period ($=t_1+t_2+t_3$) thereof. Since the periods of times $t_1$, $t_2$, $t_3$ for which the oscillating signals a, b, c are outputted comprise unit periods of the oscillating signals a, b, c, respectively, these oscillating signals a, b, c have positive-going edges occurring where they switch from one to another.

The periods of times $t_1$, $t_2$, $t_3$ for which the oscillating signals a, b, c are outputted can be varied. Specifically, the switching circuit 9 has a plurality of variable resistors 13, 14, 15 (see FIG. 1) for establishing the periods of times $t_1$, $t_2$, $t_3$ for the respective oscillating signals a, b, c. The periods of times $t_1$, $t_2$, $t_3$ can be set to desired values by varying the resistances of the variable resistors 13, 14, 15 through respective control knobs (not shown). It is possible to set the periods of times $t_1$, $t_2$, $t_3$ to "0". When the periods of times $t_1$, $t_2$, $t_3$ are set to "0", the oscillating signals a, b, c are not outputted from the switching circuit 9.

In this embodiment, the periods of times $t_1$, $t_2$, $t_3$ are set to relatively short periods of time, e.g., 1 second, 0.5 second, and 0.25 second, respectively.

Operation of the ultrasonic vibrating apparatus will be described below.

The composite signal d outputted from the switching circuit 9 is amplified by the amplifier 10 and then applied to the ultrasonic vibrator 1. Inasmuch the composite signal d is composed of a time series of oscillating signals a, b, c of different frequencies for respective periods of times (also referred to as "output periods") $t_1$, $t_2$, $t_3$ within each period thereof, as described above, the ultrasonic vibrator 1 is oscillated successively at the frequencies of the oscillating signals a, b, c, and such successive oscillation at the frequencies of the oscillating signals a, b, c is repeated in the periods of the composite signal d. Because the frequencies of the oscillating signals a, b, c are integral multiples of the natural frequency of the ultrasonic vibrator 1 and the oscillating signals a, b, c are successively outputted as a time series for the respective output periods $t_1$, $t_2$, $t_3$ composed of unit periods of the oscillating signals a, b, c, thus generating the periodic signal d, the ultrasonic vibrator 1 can smoothly be oscillated at the successive frequencies of the oscillating signals a, b, c. Accordingly, as shown in FIGS. 3(*a*) through 3(*c*), the ultrasonic vibrator 1 repeatedly radiates ultrasonic energies e, f, g having different frequencies into the cleaning solution 4 at relatively short periods.

Figures 3A, 3B, 3C:
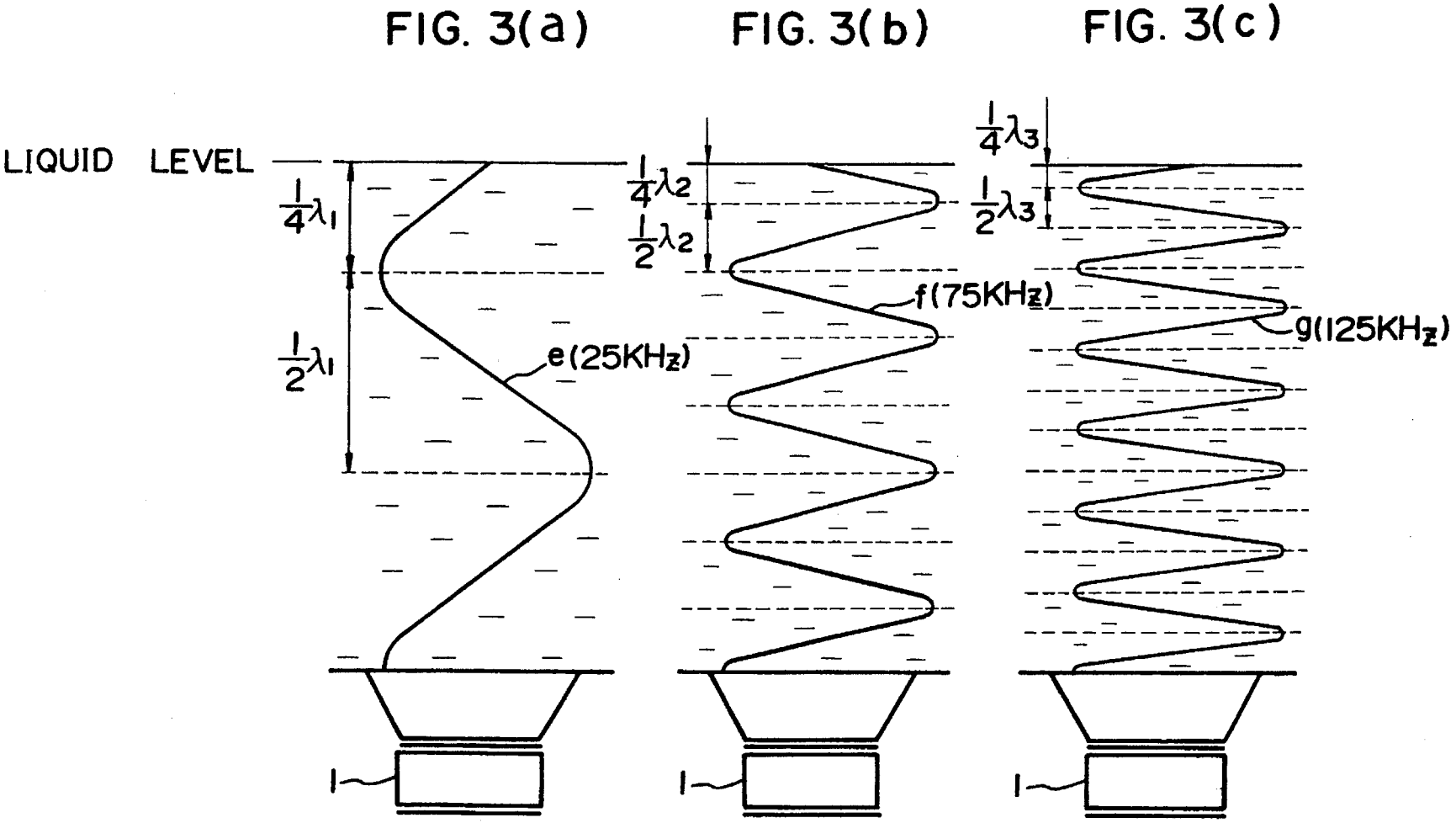
FIGS. 3(*a*), 3(*b*) and 3(*c*) are diagrams illustrative of the manner in which the ultrasonic vibrating apparatus operates.

FIGS. 3(*a*) through 3(*c*) illustrate the ultrasonic energies e, f, g, respectively, which correspond to the oscillating signals a, b, c whose frequencies $f_1$, $f_2$, $f_3$ are 25 kHz, 75 kHz, and 125 kHz. The frequencies of the ultrasonic energies e, f, g are the same as the respective frequencies of the oscillating signals a, b, c. The ultrasonic energies e, f, g have respective wavelengths $\lambda_1$, $\lambda_2$, $\lambda_3$. Cavitations are intensively produced in the cleaning solution 4 at depths indicated by the broken lines shown in FIGS. 3(*a*) through 3(*c*) which correspond to the wavelengths $\lambda_1$, $\lambda_2$, $\lambda_3$.

As the wavelengths $\lambda_1$, $\lambda_2$, $\lambda_3$ of the ultrasonic energies e, f, g, respectively, which correspond to the oscillating signals a, b, c differ from each other, the depths at which the cavitations are produced by these ultrasonic energies e, f, g also differ from each other. With the output periods $t_1$, $t_2$, $t_3$ being relatively short, the cavitations which correspond to the ultrasonic energies e, f, g are repeatedly produced at short intervals of time. Consequently, on the basis of a period of time that is sufficiently longer than the output periods $t_1$, $t_2$, $t_3$, the cavitations generated in the cleaning solution 4 are distributed relatively uniformly therein. Thus, when workpieces (not shown) are immersed in the cleaning solution while the ultrasonic energies e, f, g are being radiated therein, cavitations act on various locations on the workpieces, effectively cleaning and deburring the workpieces. If an ultrasonic energy having a fixed frequency were radiated into the cleaning solution for a relatively long period of time, then air bubbles would be attached to the surfaces of the workpieces immersed in the cleaning solution, tending to prevent the workpieces from being cleaned. According to the present invention, however, the ultrasonic frequency is periodically varied to prevent air bubbles from remaining attached to the surfaces of the workpieces. Therefore, the workpieces can be cleaned highly effectively.

In the above ultrasonic cleaning apparatus, it is possible to vary the output periods $t_1$, $t_2$, $t_3$ of the oscillating signals a, b, c for radiating the ultrasonic energies e, f, g having different frequencies.

More specifically, the higher the ultrasonic frequency, the greater the cavitation effect becomes. For example, when relatively fragile workpieces are to be cleaned, it is preferable to employ an ultrasonic energy having a higher frequency in order to prevent the workpieces from being damaged. Therefore, to clean fragile workpieces with the ultrasonic cleaning apparatus, the output period $t_1$ of the oscillating signal a having the lowest frequency is sufficiently shortened or reduced to "0", and the other ultrasonic energies are radiated to clean the workpieces while avoiding damage to the workpieces.

Conversely, when workpieces are to be cleaned for a greater cleaning effect, the output periods $t_1$, $t_2$ of the oscillating signals a, b having the lowest and second lowest frequencies are set to relatively long values. In this manner, the workpieces can be cleaned effectively.

In this embodiment, the oscillating signals a, b, c for energizing the ultrasonic vibrator 1 and hence the composite signal d are rectangular-wave signals. Consequently, the ultrasonic vibrator 1 can be oscillated by the oscillating signals a, b, c with a smooth response, so that the ultrasonic vibrator 1 can stably be oscillated by the oscillating signals a, b, c. Use of the rectangular-wave signals permits the ultrasonic vibrating apparatus to be comparatively simple in circuit arrangement.

The output control circuit 11 (see FIG. 1) adjusts the gain (amplification factor) of the amplifier 10 depending on the frequencies of the oscillating signals a, b, c successively outputted from the switching circuit 9, as follows: Generally, the higher the frequency of the signal applied to the ultrasonic vibrator 1, the larger the current flowing into the ultrasonic vibrator 1 and the amplifier 10. If an excessive current flowed into the ultrasonic vibrator 1 and the amplifier 10, then they would be liable to be damaged. According to this embodiment, the output control circuit 11 reduces the gain of the amplifier 10 to a lower level as the frequency of the oscillating signal from the switching circuit 10 goes higher, for thereby preventing an excessive current from flowing into the ultrasonic vibrator 1 and the amplifier 10 and hence protecting them from damage.

When the oscillating signals a, b, c supplied to the amplifier 10 switch from one to another, the output control circuit 11 lowers the gain of the amplifier 10 to approximately "0", and thereafter gradually increases the gain of the amplifier 10 to amplification factors commensurate with the respective frequencies of the oscillating signals a, b, c. Specifically, if the gain of the amplifier 10 were of a constant level corresponding to the frequency of one of the oscillating signals a, b, c from the time oscillating signals a, b, c switch from one to another, then since the frequency of the signal applied to the ultrasonic vibrator 1 would be abruptly varied, the oscillation of the ultrasonic vibrator 1 would be abruptly disturbed, tending to cause noise. According to the present invention, the gain of the amplifier 10 is reduced to "0" when the oscillating signals a, b, c switch from one to another, as described above. Consequently, right after the oscillating signals a, b, c switch from one to another, the level of the signal applied to the ultrasonic vibrator 1 gradually increases from a low level, permitting the ultrasonic vibrator 1 to start oscillating smoothly at the frequencies of the oscillating signals a, b, c.

In addition, the frequency adjusting circuit 12 (see FIG. 1) effects fine adjustment on the oscillating frequency (frequency of the reference signal) of the reference signal oscillator 5 depending on the current supplied from the amplifier 10 to the ultrasonic vibrator 1. More specifically, when the ultrasonic vibrator 1 oscillates, the natural frequency thereof generally varies slightly due to the heat thereof. If the frequencies of the oscillating signals a, b, c were fixed at all times, therefore, the current flowing into the ultrasonic vibrator 1 would be varied, causing the ultrasonic vibrator 1 to output unstable ultrasonic energies. According to this embodiment, the oscillating frequency of the reference signal oscillator 5 is finely adjusted by the frequency adjusting circuit 12 so as to maintain the current flowing into the ultrasonic vibrator 1 at an optimum level for thereby equalizing the frequencies of the oscillating signals a, b, c with integral multiples of the actual natural frequency of the ultrasonic vibrator 1. In such a fine adjustment process, the oscillating frequency of the reference signal oscillator 5 is varied across its rated frequency at suitable time intervals until an oscillating frequency is detected at which the current supplied to the ultrasonic vibrator 1 is of a predetermined optimum level, e.g., a maximum level. The frequency adjustment may be made depending on the sound pressure of the ultrasonic energy that is radiated from the ultrasonic vibrator 1 into the cleaning solution.

Figure 6:
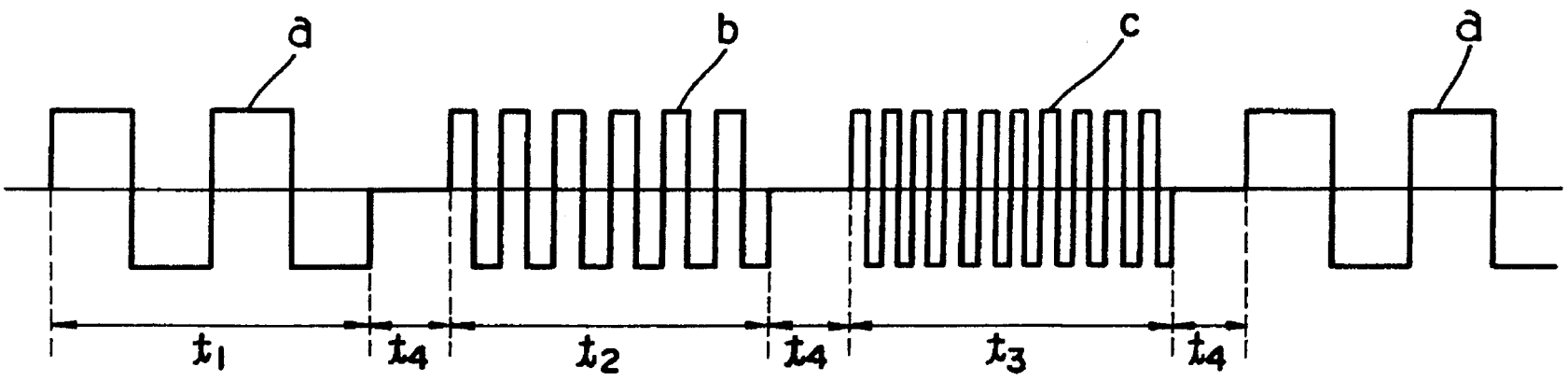
FIG. 6 is a diagram of another example of signals applied to the ultrasonic vibrator.

In the illustrated embodiment, the oscillating signals a, b, c are successively switched and outputted for the respective output periods $t_1$, $t_2$, $t_3$ by the switching circuit 9. However, as shown in FIG. 6, quiescent periods $t_4$ may be inserted between the output periods $t_1$, $t_2$, $t_3$ of the oscillating signals a, b, c, and the oscillating signals a, b, c spaced by the quiescent periods $t_4$ may be amplified and outputted to the ultrasonic vibrator 1. At this time, the ultrasonic vibrator 1 radiates ultrasonic energies having the frequencies of the oscillating signals a, b, c intermittently for the respective output periods $t_1$, $t_2$, $t_3$. In this case, cavitations are also produced at different depths corresponding to the frequencies of the oscillating signals a, b, c in the cleaning solution 4. The cavitations thus produced are thus distributed relatively uniformly in the cleaning solution 4.

While the oscillating signals a, b, c are periodically supplied in the named order to the ultrasonic vibrator 1 to oscillate the ultrasonic vibrator 1 in the illustrated embodiment, the oscillating signals a, b, c may be applied in any optional or random order to the ultrasonic vibrator 1.

In the above ultrasonic cleaning apparatus, the frequencies of the oscillating signals a, b, c may basically be integral multiples of the natural frequency of the ultrasonic vibrator 1. More preferably, the frequencies of the oscillating signals a, b, c should be multiples by odd numbers of the natural frequency of the ultrasonic vibrator 1.

The reasons for the multiples by odd numbers of the natural frequency of the ultrasonic vibrator 1 will be described below with reference to FIGS. 4(*a*) and 4(*b*) .

Figure 4A:
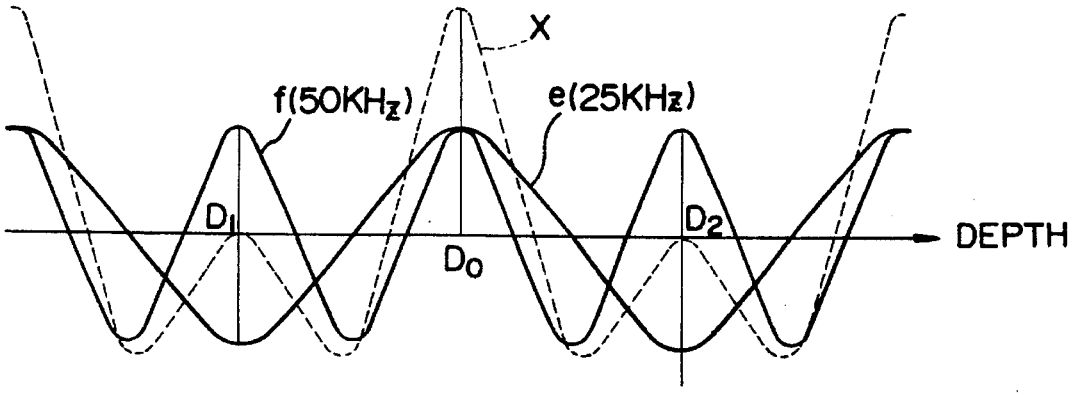
FIGS. 4(*a*) and 4(*b*) are diagrams illustrative of the manner in which the ultrasonic vibrating apparatus operates.
Figure 4B:
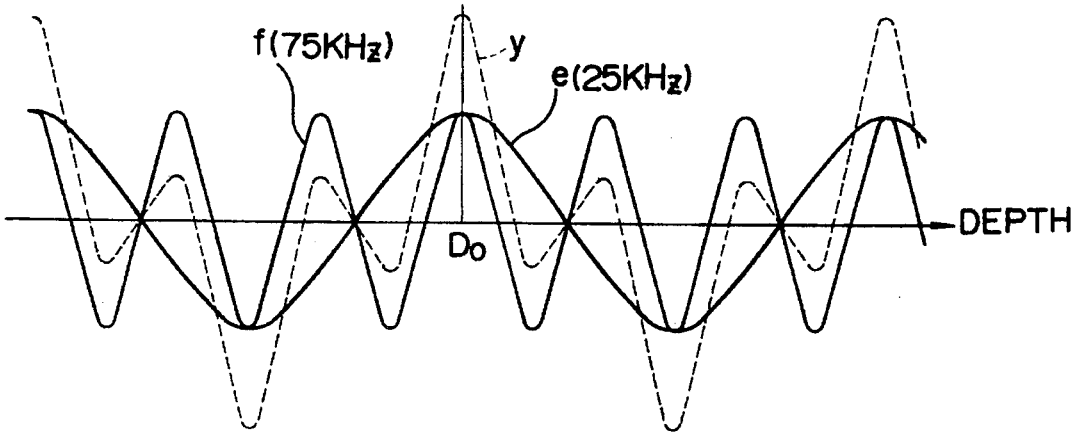

FIG. 4(*a*) illustrates the waveforms of the ultrasonic energies e, f that are produced in the cleaning solution 4 by the respective oscillating signals a, b when the frequencies of the oscillating signals a, b are 25 kHz (the natural frequency of the ultrasonic vibrator 1) and 50 kHz (twice the natural frequency of the ultrasonic vibrator 1). The horizontal axis of the graph shown in FIG. 4(*a*) represents the depth in the cleaning solution 4, whereas the vertical axis represents the amplitude of the ultrasonic energies e, f. It is assumed in FIG. 4(*a*) that the waveforms of the ultrasonic energies e, f have overlapping crests at a depth $D_0$.

As can be seen from FIG. 4(*a*), where the frequency of the oscillating signal b is twice (a multiple by an even number of) the natural frequency of the ultrasonic vibrator 1, then crests of the waveform of the ultrasonic energy e and valleys of the waveform of the ultrasonic energy f overlap each other at depths $D_1$, $D_2$, for example. Therefore, a composite waveform x composed of a combination of the waveforms of the ultrasonic energies e, f is asymmetrical with respect to the horizontal axis at the center of the amplitude. This indicates that a distribution of cavitations that are produced by the combination of the ultrasonic energies e, f is apt to become ununiform. A similar asymmetrical composite waveform will be produced if the frequency of the oscillating signal c is 100 kHz, which is four times the natural frequency of the ultrasonic vibrator 1.

FIG. 4(*b*) illustrates the waveforms of the ultrasonic energies e, f that are produced in the cleaning solution 4 by the respective oscillating signals a, b when the frequencies of the oscillating signals a, b are 25 kHz (the natural frequency of the ultrasonic vibrator 1) and 75 kHz (three times the natural frequency of the ultrasonic vibrator 1). The horizontal axis of the graph shown in FIG. 4(*b*) represents the depth in the cleaning solution 4, whereas the vertical axis represents the amplitude of the ultrasonic energies e, f. It is assumed in FIG. 4(*b*) that the waveforms of the ultrasonic energies e, f have overlapping crests at a depth $D_0$.

As can be seen from FIG. 4(*b*) , where the frequency of the oscillating signal b is three times (a multiple by an odd number of) the natural frequency of the ultrasonic vibrator 1, then crests of the waveform of the ultrasonic energy e and crests of the waveform of the ultrasonic energy f overlap each other. Therefore, a composite waveform y composed of a combination of the waveforms of the ultrasonic energies e, f is symmetrical with respect to the horizontal axis at the center of the amplitude. This indicates that a distribution of cavitations that are produced by the combination of the ultrasonic energies e, f is apt to become uniform. A similar symmetrical composite waveform will be produced if the frequency of the oscillating signal c is 125 kHz, which is five times the natural frequency of the ultrasonic vibrator 1.

In view of the above analysis with reference to FIGS. 4(*a*) and 4(*b*), the frequencies of the oscillating signals a, b, c should preferably be multiples by odd numbers of the natural frequency of the ultrasonic vibrator 1.

While three oscillating signals a, b, c having different frequencies are employed in the above embodiment, more oscillating signals having different frequencies may be employed to radiate corresponding ultrasonic energies into the cleaning solution.

Actual cavitation effects that occurred when signals having frequencies which are integral multiples of the natural frequency of the ultrasonic vibrator 1 were applied to the ultrasonic vibrator 1 will be described below with reference to FIGS. 5(*a*) and 5(*b*) .

The inventors conducted an experiment in which aluminum foils having a thickness of 7 μm were vertically immersed in the cleaning solution 4, and rectangular-wave signals having frequencies of 25 kHz and 50 kHz, which are equal to and twice the natural frequency of the ultrasonic vibrator 1, were separately applied to the ultrasonic vibrator 1, and observed erosions developed on the aluminum foils. In the experiment, the cleaning solution 4 was water having a DO value of 5.0 ppm, kept at a temperature of 24° C., and had a depth of 232 mm. The eroded conditions of the aluminum foils are shown in FIGS. 5(*a*) and 5(*b*), respectively.

Figure 5A:
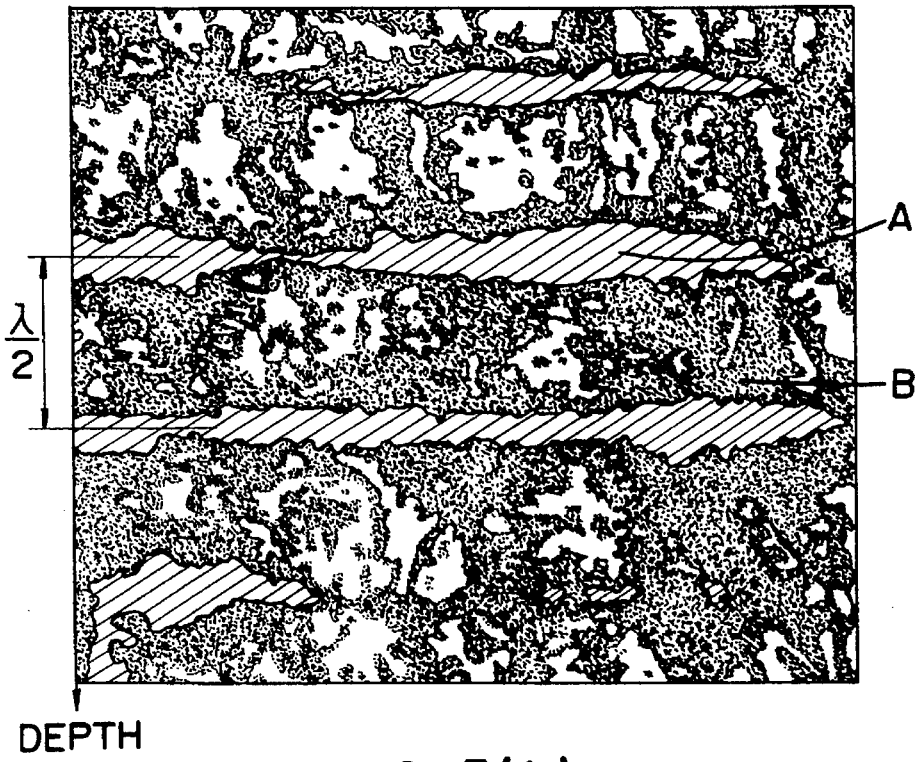
FIG. 5(*a*) is a plan view of an aluminum foil which was eroded when an ultrasonic vibrator of the ultrasonic vibrating apparatus shown in FIG. 1 is energized at a certain frequency.
Figure 5B:
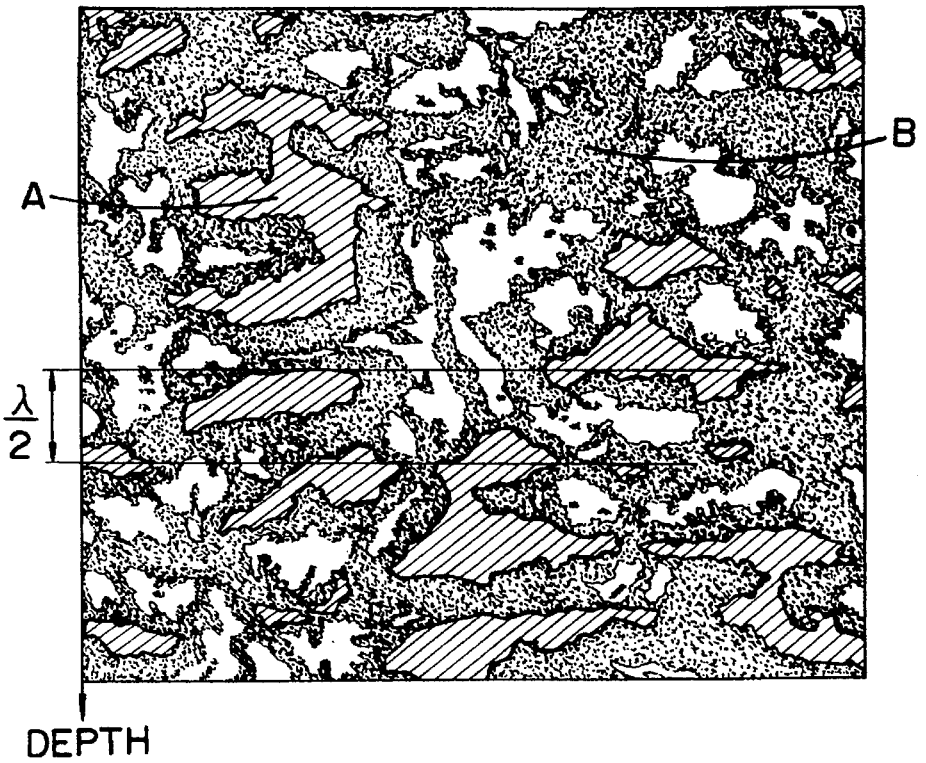

In FIGS. 5(*a*) and 5(*b*), hatched regions A show holes produced in the aluminum foils, and stippled regions B show erosions that were developed to a certain extent in the aluminum foils. These eroded regions A, B indicate that cavitations are produced in the cleaning solution 4 at corresponding depths therein.

As shown in FIG. 5(*a*), when the ultrasonic vibrator 1 was energized at the same frequency (25 kHz) as the natural frequency thereof, the eroded regions A, B appeared at depths that are spaced by a substantially half wavelength. The observation indicates that cavitations are intensively produced at the depths that are spaced by a substantially half wavelength.

As shown in FIG. 5(*b*) , when the ultrasonic vibrator 1 was energized at a frequency (50 kHz) which is twice the natural frequency thereof, the eroded regions A, B also appeared at depths that are spaced by a substantially half wavelength, indicating that cavitations are intensively produced at the depths that are spaced by a substantially half wavelength. The extent of the erosions is slightly smaller than the extent of the erosions that were developed when the ultrasonic vibrator 1 was energized at 25 kHz. However, since erosions that were strong enough to form holes in the aluminum foil are observed, it can be seen that cavitations with a sufficient cleaning effect were produced when the ultrasonic vibrator 1 was energized at 50 kHz. The wavelength of the ultrasonic energy generated when the ultrasonic vibrator 1 was energized at 50 kHz was half the wavelength of the ultrasonic energy generated when the ultrasonic vibrator 1 was energized at 25 kHz. Accordingly, the interval between the depths at which intensive cavitations were produced when the ultrasonic vibrator 1 was energized at 50 kHz is substantially half that when the ultrasonic vibrator 1 was energized at 25 kHz, indicating that the cavitations appeared at closer depths in the cleaning solution.

Therefore, even when the ultrasonic vibrator 1 is energized at a frequency that is twice the natural frequency of the ultrasonic vibrator 1, it is possible to produce sufficient cavitations required to clean workpieces immersed in the cleaning solution, and also to produce cavitations at depths different from whose when the ultrasonic vibrator 1 is energized at its natural frequency.

It thus follows that, as described above with respect to the illustrated embodiment, when the ultrasonic vibrator 1 is energized by a composite signal having a time series of different frequencies that are integral multiples of the natural frequency of the ultrasonic vibrator 1, cavitations can be produced in a relatively uniform distribution in the cleaning solution for a large cleaning effect on the workpieces immersed in the cleaning solution.

Although certain preferred embodiments of the present invention has been shown and described in detail, it should be understood that various changes and modifications may be made therein without departing from the scope of the appended claims.

What is claimed is:

1. A method of oscillating an ultrasonic vibrator for radiating ultrasonic energy into a cleaning solution, comprising the steps of:

(a) providing an ultrasonic vibrator mounted on an ultrasonic cleaning tank, said ultrasonic vibrator having a single natural frequency;

(b) generating a plurality of oscillating signals having respective different frequencies which are integral multiples of said single natural frequency of the ultrasonic vibrator;

(c) switching between and outputting said oscillating signals for respective periods of time thereby to generate a composite signal which is composed of a time series of said oscillating signals; and (d) applying said composite signal as a drive signal to oscillate the ultrasonic vibrator for radiating ultrasonic energy into the cleaning solution in said cleaning tank.

2. A method according to claim 1, wherein said step (c) comprises the step of outputting said oscillating signals successively for said respective periods of time.

3. A method according to claim 1, wherein said step (c) comprises the steps of outputting one of said oscillating signals, and then after elapse of a predetermined quiescent period, outputting a next one of said oscillating signals.

4. A method according to claim 2, wherein each of said respective periods of time is an integral multiple of one period of one of said oscillating signals.

5. A method according to claim 1, wherein said step (c) comprises the step of varying said respective periods of time for the respective oscillating signals.

6. A method according to claim 1, wherein said step (d) comprises the step of applying a rectangular-wave signal having the same frequency as said composite signal to the ultrasonic vibrator to oscillate the ultrasonic vibrator.

7. A method according to claim 1, wherein said frequencies of the oscillating signals are multiples by odd numbers of the natural frequency of the ultrasonic vibrator.

8. A method according to claim 1, wherein said step (d) comprises the steps of amplifying said composite signal, controlling the amplification of said composite signal depending on the frequencies of said oscillating signals, and applying the amplified composite signal to the ultrasonic vibrator to oscillate the ultrasonic vibrator, wherein said step of controlling the amplification of said composite signal comprises the step of reducing said amplification as the frequencies of said oscillating signals become higher.

9. A method according to claim 2, wherein said step (d) comprises the steps of amplifying said composite signal, reducing the amplification of said composite signal when the oscillating signals are switched from one to another, and thereafter progressively increasing said amplification to a predetermined level.

10. A method according to claim 1, wherein said step (b) comprises the steps of generating a reference signal having a single frequency which is substantially an integral multiple of the natural frequency of the ultrasonic vibrator, adjusting the frequency of said reference signal depending on the level of a current supplied to the ultrasonic vibrator in order to equalize the frequency of said reference signal with the integral multiple of the natural frequency of the ultrasonic vibrator, and frequency-dividing said reference signal whose frequency has been adjusted to produce said oscillating signals.

* * * * *